US006743480B1

(12) United States Patent
Almog et al.

(10) Patent No.: US 6,743,480 B1
(45) Date of Patent: Jun. 1, 2004

(54) METHOD FOR PREPARING A PLASTIC SURFACE FOR PRINTING WITH TONER

(75) Inventors: Yaacov Almog, Nes-Ziona (IL); Sergio Brandriss, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 10/203,594

(22) PCT Filed: Feb. 10, 2000

(86) PCT No.: PCT/IL00/00084

§ 371 (c)(1),
(2), (4) Date: Aug. 9, 2002

(87) PCT Pub. No.: WO01/58695

PCT Pub. Date: Aug. 16, 2001

(51) Int. Cl.[7] ..... B05D 3/02
(52) U.S. Cl. ..... 427/359; 427/393.5
(58) Field of Search ..... 427/385.5, 359, 427/393.5

(56) References Cited

U.S. PATENT DOCUMENTS

| | | | | |
|---|---|---|---|---|
| 3,655,705 A | | 4/1972 | Lengnick | |
| 4,764,399 A | * | 8/1988 | Harrison | 427/275 |
| 4,832,984 A | | 5/1989 | Hasegawa et al. | |
| 5,407,771 A | | 4/1995 | Landa et al. | |
| 5,631,119 A | | 5/1997 | Shinozaki | |

FOREIGN PATENT DOCUMENTS

| | | |
|---|---|---|
| BR | 8601993 | * 11/1987 |
| DE | 2940370 | * 4/1981 |
| EP | 0 474 278 | 3/1992 |
| WO | WO 99/54143 | 10/1999 |
| WO | WO 01/22172 | * 3/2001 |

* cited by examiner

*Primary Examiner*—Erma Cameron
(74) *Attorney, Agent, or Firm*—Fenster & Company

(57) ABSTRACT

A method for preparing a plastic surface for printing with a toner comprising: forming a layer of an aqueous mixture comprising a first material and a second material on the surface, wherein the first material has an affinity for the plastic and the second material has an affinity for the first material and the toner, and drying the layer.

27 Claims, 1 Drawing Sheet

METHOD FOR PREPARING A PLASTIC SURFACE FOR PRINTING WITH TONER

RELATED APPLICATIONS

The present application is a U.S. national application of PCT/IL00/00084, filed Feb. 10, 2000.

The invention relates to printing on plastic and in particular to promotion of adhesion of printing inks to a plastic surface.

BACKGROUND

Surfaces of plastic products of all types) such as for example plastic shopping bags, place mats, and decals are printed for purposes of advertisement and decoration. However, there are many plastics to which common printing inks do not readily adhere. Often a plastic surface that is to be printed must be treated prior to printing so that inks that are used to print the su adhere properly to the surface. The treatment generally comprises coating the surface with a primer material that has a high affinity for both the plastic surface and the inks used to print the surface. The affinities of the primer for both the plastic and the ink bonds ink applied to the primer coated surface to the surface. Typically, the primer comprises or is mixed with volatile organic compounds potentially dangerous to human health that are released into the atmosphere during application of the primer to the surface. In order to protect people present in work areas where the primer is being used from exposure to the compounds, substantial resources have to be invested to properly ventilate the work areas and to monitor concentrations of the compounds in the air in the work areas.

SUMMARY OF THE INVENTION

An aspect of some preferred embodiments of the present invention relates to providing a primer, hereinafter referred to as a "pollution free primer", for bonding a toner ink to a plastic surface that does not release organic compounds into the air.

An aspect of some preferred embodiments of the present invention relates to providing a pollution free primer that adheres with appropriate forces to the plastic surface and the toner so that the toner can be applied to the surface using an offset process.

An aspect of some preferred embodiments of the present invention relates to providing a primer that when applied to the plastic surface flows and wets the surface to provide a substantially uniform coating on the surface.

In a preferred embodiment of the present invention the primer comprises an aqueous solution of a first material having a strong affinity for the plastic surface mixed with a second material having a strong affinity for the first material and the toner. The affinities of the primer components for each other and for the plastic and the toner are such that the toner is efficiently transferred to the plastic from a blanket used in an offset printing process. Preferably the first and second materials form relatively strong bonds to each other at least when dried. Hereinafter, the first material is referred to as a "plastic bonding-agent" and the second material is referred to as a "toner bonding-agent".

In a preferred embodiment of the present invention, the plastic bonding-agent is polyethylenimine (PEI) and the toner bonding-agent is a dispersed phase of MP4990, which is an aqueous dispersion of copolymer of polyethylene and acrylic acid, manufactured by Michelman. Preferably, the primer is mixed with a surfactant that enhances wetting of the plastic surface by the primer and promotes formation of a uniform coating of the primer on the plastic surface.

The inventors have found that a thin substantially uniform coating of the primer can be applied to a side of a sheet or web of plastic using a gravure printing process. The primer adheres well to the plastic and the primer coated surface can be printed with liquid toners, such as for example those described in U.S. Pat. No. 5,407,771 to Landa et al., the disclosure of which is incorporated herein by reference. Preferably, the toners are ElectroInk® produced and sold by Indigo N. V. of the Netherlands such as ElectroInk® EI-Mark 3.0 and EI-Mark 3.1. Other toners can be used.

There is therefore provided in accordance with a referred embodiment of the present invention a method for preparing a plastic surface for printing with a toner comprising: forming a layer of an aqueous mixture comprising a first material and a second material on the surface, wherein the first material has an affinity for the plastic and the second material has an affinity for the first material and the toner; and drying the layer.

Preferably, the first material is polyethylenimine. Preferably, the second material is a material chosen from the group of materials comprising: polyethylene acrylic acid copolymer, styrene acrylate copolymer and styrene-butadiene. Peferably, the weight of the first material plus the weight of the second material is between about 2% and about 10% of the weight of the mixture.

Additionally or alternatively, the ratio of the weight of the second material to the weight of first material in the mixture is between 1 and 5. In some preferred embodiments of the present invention, the ratio of the weight of the second material to the weight of the first material in the mixture is substantially equal to 1. In some preferred embodiments of the present invention, the ratio of the weight of the second material to the weight of the first material in the mixture is substantially equal to 2. In some preferred embodiments of the present invention, the ratio of the weight of the second material to the weight of the fist material in the mixture is substantially equal to 3.

In some preferred embodiments of the present invention, the second material is polyethylene acrylic acid copolymer. In some preferred embodiments of the present invention, the second material is styrene acrylate copolymer. In some preferred embodiments of the present invention, the second material is styrene-butadiene.

According to some preferred embodiments of the present invention, the method comprises adding a surfactant to the mixture. Preferably, the surfactant is chosen from the group of materials comprising: 2,4,7,9-tetramethyl-5-decyn-4, 7-diol; 2,4,7,9-tetramethyl-5-decyn-4, 7-diol+3.5 moles ethylene oxide; and sodium dodecyl sulfate.

In some preferred embodiments of the present invention, the surfactant is 2,4,7,9-tetramethyl-5-decyn-4, 7-diol. In some preferred embodiments of the present invention, the: surfactant is 2,4,7,9-tetramethyl-5-decyn-4, 7-diol+3.5 moles ethylene oxide. Additionally or alternatively, after addition of the surfactant, the mixture comprises between 1% and 1.5% by weight surfactant.

In some preferred embodiments of the present invention, the surfactant is sodium dodecyl sulfate. Preferably, after addition of the surfactant, the mixture comprises between 2% and 2.5% by weight surfactant.

In some preferred embodiments of the present invention, the first material is dissolved in water. Preferably, the solution of the first material comprises between 2% and 10%/ by, weight of the first material.

In some prefer embodiments of the present invention, the second material is dispersed in water. Preferably, the aqueous dispersion of the second material comprises between 2% and 10% by weight of the second material.

In some preferred embodiments of the present invention, forming the layer comprises preparing the mixture in accordance with a procedure comprising: preparing an aqueous solution of the first material; preparing an aqueous dispersion of the second material; and mixing together the aqueous solution and the aqueous dispersion to prepare the mixture.

In some preferred embodiments of the present invention, forming a layer comprises forming a layer of an aqueous mixture that does not release organic compounds into the air during drying thereof.

In some preferred embodiments of the present invention, forming a layer comprises forming a layer having a weight per square meter of plastic between 0.10 and 0.20 grams after the layer is dry. In some preferred embodiments of the present invention, forming a layer comprises forming a layer having a weight per square meter of plastic between 0.125 and 0.175 grams after the layer is dry. In some preferred embodiments of the present invention, forming a layer comprises forming a layer having a weight per square meter of plastic between 0.135 and 0.165 grams after the layer is dry. In some preferred embodiments of the present invention, forming a layer comprises forming a layer having a weight per square meter of plastic substantially equal to 0.15 grams after the layer is dry.

In some preferred embodiments of the present invention, forming a layer of the mixture on the surface comprises applying the mixture to the surface using a gravure roller.

In some preferred embodiments of the present invention forming a layer of the mixture on the surface comprises applying the mixture to the surface using a gravure roller.

BRIEF DESCRIPTION OF FIGURES

The invention will be more clearly understood from the following description of preferred embodiments thereof read with reference to figures attached hereto. In the figures, identical structures, elements or parts that appear in more than one figure are generally labeled with the same numeral in all the figures in which they appear. Dimensions of components and features shown in the figures are chosen for convenience and clarity of presentation and are not necessarily shown to scale. The figures are listed below.

DETAILED DESCRIPTION OF PREFERRED EMBODIMENTS

Figure 1:
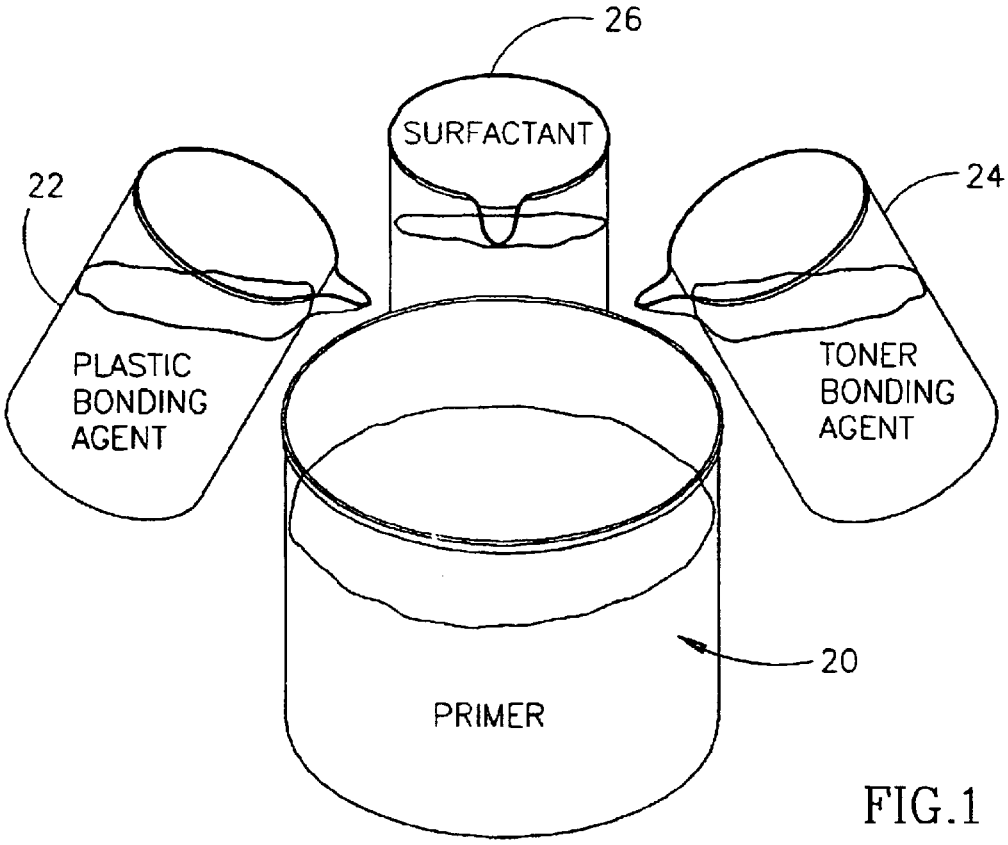
FIG. 1 schematically shows preparation of a primer, in accordance with a preferred embodiment of the present invention.

FIG. 1 schematically illustrates preparation of a quantity of primer 20 by mixing an aqueous solution 22 of a water-soluble plastic bonding-agent with an aqueous dispersion 24 of an toner bonding-agent, in accordance with a preferred embodiment of the present invention. Preferably, the plastic bonding-agent is polyethylenimine. Preferably, solution 22 is 6%±4% (i.e. from 2% to 10%) by weight of polyethylenimine.

In some preferred embodiments of the present invention, the toner bonding-agent is dispersed phase of MP4990 and the amount by weight of dispersed phase of MP4990 in aqueous dispersion 24 is preferably about the same as the amount by weight of polyethylenimine in solution 22. Preferably polyethylenimine solution 22 and "MP4990 dispersion 24" are mixed together in equal quantities by weight. However, a quantity of MP4990 dispersion 24 may be mixed with a quantity of polyethylenimine solution 22 so that the ratio by weight of dispersed phase of MP4990 to polyethylenimine in primer 20, in accordance with a preferred embodiment of the present invention, has any value in a range from 1 to 5. The large mixing range is possible because dispersed phase of MP4990 has an affinity of its own to plastic.

Other toner bonding-agents usable to prepare primer 20, in accordance with a preferred embodiment of the present invention, are a dispersed phase of Styrofan, Acronal 866 or Styronal D808. Styrofan and Styronal are trade names for aqueous polymer dispersions based on styrene-butadiene sold by BASF. Acronal is a trade name for acrylate homopolymers and copolymers in dispersed form sold by BASF. For these materials, aqueous dispersion 24 is by weight, preferably, 8%±4% of a dispersed phase of Styrofan, Acronal 866 or Styronal D808. As in the case for dispersion 24 formed with MP4990, dispersion 24 formed with Styrofan, Acronal and Styronal is preferably mixed with 6% polyethylenimine solution 22 in equal parts by weight of dispersion 24 to solution 22 to form primer 20. A quantity of dispersion 24 based on Styrofan, Acronal or Styronal may be mixed with a quantity of polyethylenimine solution 22 to provide a primer 20 in which the ratio of dispersed phase of Styrofan, Acronal or Styronal to polyethylenimine in the primer has a range between 1 and 5, in accordance with a preferred embodiment of the present invention.

In some preferred embodiments of the present invention, a surfactant 26 is added to primer 20. In some preferred embodiments of the present invention, the surfactant is a solute in Surfynol 104E, which is an aqueous solution of 2,4,7,9-tetramethyl-5-decyn-4, 7-diol, mfg. by Air Products Inc. Surfynol 104E is added to primer 20 so that preferably, after addition, the primer comprises between 1%–1.5% by weight of the solute in Surfynol 104E" (i.e. 2,4,7,9-tetramethyl-5-decyn-4, 7-diol). In some preferred embodiments of the present invention the surfactant is a solute in Surfynol 440, which is the solute in Surfynol 104+3.5 moles Ethylene oxide, mfg. By Air Products Inc. Surfynol 440 is added to primer 20 so that preferably, after addition, the primer comprises by weight about 1% to 1.5% of the solute in Surfynol 440. In some preferred embodiments of the present invention the surfactant is sodium dodecyl sulfate which is added to primer 20 so that after addition the primer comprises by weight about 2% to 2.5% surfactant In the case of addition of a surfactant, preferably the amount by weight of polyethylenimine plus dispersed phase of MP4990, Styrofan, Acronal or Styronal in primer 20 is between 2% and 10%.

It should be noted that the above method for preparing a primer in accordance with a preferred embodiment of the present invention is given by way of example. Other methods known in the art for combining materials to prepare the primer may be used. For example, the primer can be formed by preparing an aqueous solution of a suitable plastic bonding-agent and dispersing a suitable toner bonding-agent in the solution or preparing an aqueous dispersion of the toner bonding-agent and dissolving the plastic bonding-agent in the dispersion.

Figure 2:
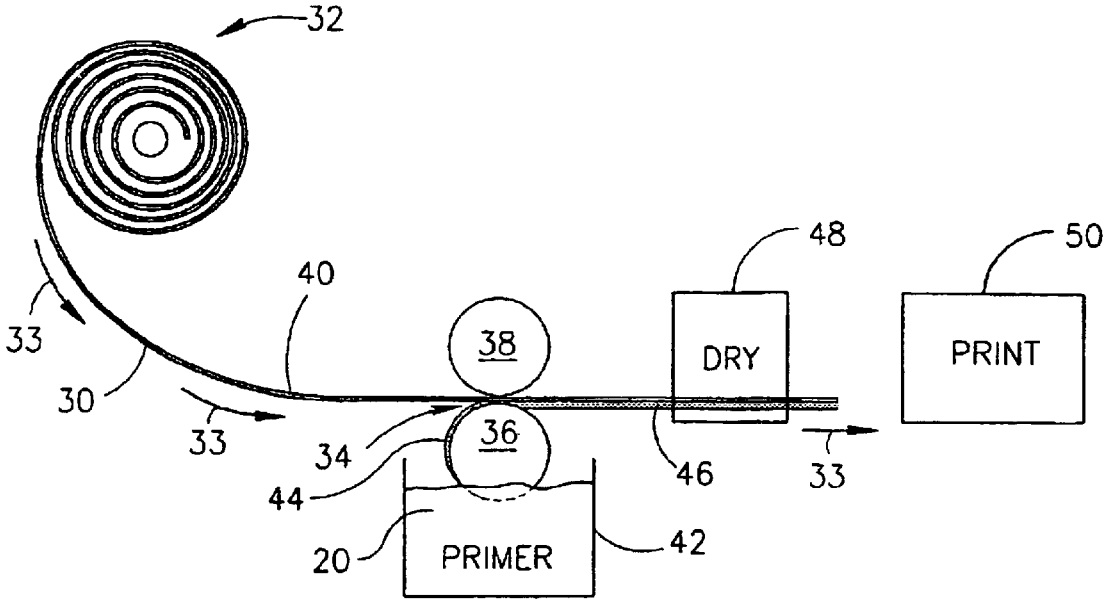
FIG. 2 schematically shows a method of printing on plastic using a primer in accordance with a preferred embodiment of the present invention.

FIG. 2 schematically illustrates printing a plastic web 30 using primer 20, in accordance with a preferred embodiment of the present invention. Web 30 is fed from a roll 32 in a direction indicated by arrows 33 so that it preferably passes between a nip 34 of a rotating gravure cylinder 36 and a backing cylinder 38. Web 30 may be formed for example from bi-axial oriented polypropylene. Preferably, a corona treated side 40 of web 30 contacts gravure cylinder 36.

Primer 20 is applied to gravure cylinder 36 from an appropriate dispenser 42 using methods known in the art. Primer 20 that is applied to gravure cylinder 36 is schematically shown as a layer 44 of primer 20 on a region of the surface of gravure cylinder 36. As web 30 passes through nip 34, gravure cylinder 36 rotates and transfers primer 20 from layer 44 on its surface to web 30 to coat the web with a layer 46 of primer 20. Preferably, after drying the weight of layer 46 is about 0.15±0.015 grams to each square meter of the surface of web 30. After passing through nip 34 and being coated with primer 20, web 30 passes through a drying station, represented by a rectangle 48, at which layer 46 of primer 20 is dried. By the time that layer 46 is dry, the plastic bonding-agent, (e.g. polyethylenimine), and the toner bonding-agent in the primer are bonded together. Web 30 then proceeds to a printer, represented by a rectangle 50, such as an Omnius printer, (mfg. By Indigo) where the primer coated surface 40 of web 30 is printed with a desired image. Preferably, web 30 is printed with liquid toner, such as for example, toners produced and sold by Indigo N. V. of the Netherlands under the trade names EI-Mark 3.0 and EI-Mark 3.1.

A liquid toner useful for practicing the present invention can be produced according to the process described below.

Ten parts, by weight, of Elvax II5950 (Mfg. By Du Pont) and five parts by weight of Isopar L (mfg. By Exxon) are mixed for one hour at low speed in a jacketed double planetary mixer connected to an oil heating unit set at 130° C. An additional five part by weight of Isopar L are added to the mixture in the planetary mixer and after adding the additional Isopar L, the mixture is mixed at high speed for an additional hour. Ten parts by weight of Isopar L, preheated to 110° C. are then added and mixing is continued for an hour. The heating unit is then turned off and mixing is continued until the temperature of the mixture in the planetary mixer drops to about 40° C.

Ninety grams of the cooled mixture is transferred to a Union Process 01 attritor together with 7.5 g of Mogul L carbon black (sold by Cabot) and 120 g of Isopar L. The mixture thus formed is ground using 3/16" stainless steel media for 24 hours with water cooling, at about 20° C. to form a toner concentrate.

The toner concentrate is diluted in Isopar L to a non-volatile solids content 1.5%. For each gram of toner solids, 5–100 mg of charge director solution is added to form the liquid toner.

Whereas in FIG. 2 a plastic web is shown being coated with a primer and printed, plastic sheets and surfaces of plastic products can also be coated with primer and printed with toner inks in accordance with a preferred embodiment of the present invention. Also, whereas in FIG. 2 the primer is shown being applied to the web using a gravure cylinder, primer may be applied to a suitable plastic surface using other methods known in the art, such as for example by spraying or wire coating. Furthermore, application and drying of primer, in accordance with a preferred embodiment of the present invention, does not have to be done "in line" during a printing process as shown in FIG. 2. Primer can be applied to a surface of a plastic web, sheet or other suitable plastic product at a fist site and at a first time and the surface can be printed at a second site at a second time. For example, after being coated with primer, the plastic web, sheet or product can be stored and printed later. In addition, in accordance with a preferred embodiment of the present invention, the primer is useable with plastics other than bi-axial oriented polypropylene.

In developing pollution free primers suitable for bonding toner inks to plastic, in accordance with preferred embodiments of the present invention, the inventors developed water-based primers comprising different materials and combinations of materials. Each of the primers was tested to determine its suitability for use in printing on plastic by applying the primer to the corona treated side of a web of bi-axial oriented polypropylene. The primer was applied to the web to a coat weight of 0.15 g/m$^2$ using a gravure roller. The web was then printed with liquid toner ink EI-3.1 using an Omnius printer. The primer was tested for adherence to the surface of the web, uniformity of the primer coating formed on the web and how well toner transferred from a blanket in the printer to the primer and fixed on the web. The primers developed and tested do not release volatile organic materials. Examples of the primers and results of testing the primers, including those primers described in the discussion of FIG. 1, are presented and discussed in the following paragraphs.

EXAMPLE 1

A primer was prepared that comprised a 20% by weight aqueous solution of n-propanol in which dispersed phase of MP4990 was dispersed to a concentration of 12% by weight The primer coating formed on the web was uniform and did not evidence patterning. However, adhesion of the primer to the web was poor as determined by a peel test. Transfer of ink from the blanket to the primer was unsuccessful and the primer detached from the web and adhered to the blanket.

EXAMPLE 2

Another primer comprised a 6% aqueous solution by weight of polyethylenimine mixed with an equal amount by weight, of a 6% aqueous dispersion of dispersed phase of MP4990. The mixture was stable and didn't exhibit phase separation. The primer adhered well to the web, however, it evidenced patterning due to relatively poor wetting of the web by the primer. Ink transfer and fixing were satisfactory.

EXAMPLE 3

A primer was prepared by forming a mixture comprising a 6% aqueous solution by weight of polyethylenimine mixed with an equal amount by weight of a 6% aqueous dispersion of dispersed phase of MP4990 (ie. the primer of Example 2) and adding to the mixture Surfynol 104E as a surfactant. The Surfynol was added to the mixture so that after addition the mixture was about 1% by weight solute from Surfynol 104E. Adhesion of the primer to the web was excellent and the primer formed a substantially uniform "un-patterned" coating on the web. Toner transferred to the primer successfully and fixing was satisfactory.

EXAMPLE 4

A primer similar to the primer of Example 3 was prepared in which Surfynol 440 was used as a surfactant added to a mixture comprising equal amounts by weight of a 6% aqueous solution of polyethylenimine and a 6% aqueous dispersion of dispersed phase of MP4990. Surfynol 440 was added to the mixture so that after addition the mixture was between 1% to 1.5% by weight solute from Surfynol 440.

Adhesion of the primer to the web was excellent and the primer formed a substantially uniform coating on the web. Toner transferred successfully to the primer and fixing was satisfactory.

EXAMPLE 5

Another primer similar to the primer of Example 3 was prepared in which sodium dodecyl sulfide was used as a surfactant added to a mixture comprising equal amounts by weight of a 6% aqueous solution of polyethylenimine and a 6% aqueous dispersion of dispersed phase of MP4990. The sodium dodecyl sulfate was added to the mixture so that after addition, the mixture was between 2%–2.5% by weight sodium dodecyl sulfate. Adhesion of the primer to the web was excellent and the primer formed a substantially uniform coating on the web. Toner transferred successfully to the primer and fixing was satisfactory.

EXAMPLE 6

A primer was prepared by mixing one part by weight of a 6% aqueous solution of polyethylenimine and three parts by weight of a 6%, by weight, aqueous dispersion of dispersed phase of Styrofan. Adhesion of the primer to the web was excellent, however, the primer coating evidenced patterning due to poor wetting of the web by the primer. Toner transfer was good and fixing was satisfactory.

EXAMPLE 7

A primer was prepared by mixing equal amounts by weight of a 6% aqueous solution of polyethylenimine and an aqueous dispersion of 12%, by weight, dispersed phase of Acronal 866. Adhesion of the primer to the web was excellent however, the primer coating evidenced patterning due to poor wetting of the web by the primer. Toner transfer was good and fixing was satisfactory.

EXAMPLE 8

Another primer was prepared by mixing equal amounts by weight of a 6% aqueous solution of polyethylenimine and an aqueous dispersion that is 12%, by weight, dispersed phase of Styronal D808. Adhesion of the primer to the web was good however, the primer coating evidenced patterning due to poor wetting of the web by the primer. Toner transfer was good and fixing was satisfactory.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of preferred embodiments thereof that are provided by way of example and are not intended to limit the scope of the invention. The described preferred embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. A method for preparing a plastic surface for printing with a toner comprising:

forming a layer of an aqueous mixture comprising a first material and a second material and a surfactant selected from the group consisting of 2,4,7,9-tetramethyl-5-decyn-4, 7-diol; 2,4,7,9-tetramethyl-5-decyn-4, 7-diol+3.5 moles ethylene oxide; and sodium dodecyl sulfate on the surface, wherein the first material has an affinity for the plastic and the second material has an affinity for the first material and the toner; and drying the layer.

2. A method according to claim 1 wherein the surfactant is 2,4,7,9-tetramethyl-5-decyn-4, 7-diol.

3. A method according to claim 1 wherein the surfactant is 2,4,7,9-tetramethyl-5-decyn-4, 7-diol+2.5 moles ethylene oxide.

4. A method according to claim 2 wherein after addition of the surfactant, the mixture comprises between 1% and 1.5% by weight surfactant.

5. A method according to claim 1 wherein the surfactant is sodium dodecyl sulfate.

6. A method according to claim 5 wherein after addition of the surfactant, the mixture comprises between 2% and 2.5% by weight surfactant.

7. A method according to claim 1 wherein layer has a weight per square meter of the plastic surface between 0.10 and 0.20 grams after the layer is dry.

8. A method according to claim 7 wherein the layer has a weight per square meter of plastic between 0.125 and 0.175 grams after the layer is dry.

9. A method according to claim 8 wherein the layer has a weight per square meter of plastic between 0.135 and 0.165 grams after the layer is dry.

10. A method according to claim 8 wherein the layer has a weight per square meter of plastic substantially equal to 0.15 grams after the layer is dry.

11. A method according to claim 1 wherein the first material is polyethylenimine.

12. A method according to claim 11 wherein the second material is a material selected from the group consisting of polyethylene acrylic acid copolymer, styrene acrylate copolymer and styrene-butadiene.

13. A method according to claim 12 wherein the weight of the first material plus the weight of the second material is between about 2% and about 10% of the weight of the mixture.

14. A method according to claim 12 wherein the ratio of the weight of the second material to the weight of first material in the mixture is between 1 and 5.

15. A method according to claim 12 wherein the ratio of the weight of the second material to the weight of the first material in the mixture is substantially equal to 1.

16. A method according to claim 12 wherein the ratio of the weight of the second material to the weight of the first material in the mixture is substantially equal to 2.

17. A method according to claim 12 wherein the ratio of the weight of the second material to the weight of the first material in the mixture is substantially equal to 3.

18. A method according to claim 12 wherein the second material is polyethylene acrylic acid copolymer.

19. A method according to claim 12 wherein the second material is styrene acrylate copolymer.

20. A method according to claim 12 wherein the second material is styrene-butadiene.

21. A method according to claim 1 wherein the first material is dissolved in water.

22. A method according to claim 21 wherein the aqueous solution of the first material comprises between 2% and 10% by weight of the first material.

23. A method according to claim 21 wherein the second material is dispersed in water.

24. A method according to claim 23 wherein the aqueous dispersion of the second material comprises between 2% and 10% by weight of the second material.

25. A method according to claim 1 wherein forming the layer comprises preparing the mixture in accordance with a procedure comprising:

preparing an aqueous solution of the first material;

preparing an aqueous dispersion of the second material; and mixing together the aqueous solution and the aqueous dispersion.

26. A method according to claim 1 wherein forming the layer comprises forming a layer of an aqueous mixture that does not release organic compounds into the air during drying thereof.

27. A method according to claim 1 wherein forming the layer of the mixture on the surface comprises applying the mixture to the surface using a gravure roller.

* * * * *

UNITED STATES PATENT AND TRADEMARK OFFICE

CERTIFICATE OF CORRECTION

PATENT NO. : 6,743,480 B1
DATED : June 1, 2004
INVENTOR(S) : Yaaeov Almog et al.

It is certified that error appears in the above-identified patent and that said Letters Patent is hereby corrected as shown below:

Column 8,
Line 15, change "+2.5" to -- +3.5 --

Signed and Sealed this

Twenty-third Day of November, 2004

JON W. DUDAS
*Director of the United States Patent and Trademark Office*